US011530102B2

(12) United States Patent
Sünder et al.

(10) Patent No.: US 11,530,102 B2
(45) Date of Patent: Dec. 20, 2022

(54) DEVICE FOR FEEDING SHEETS

(71) Applicant: KOENIG & BAUER AG, Würzburg (DE)

(72) Inventors: Martina Sünder, Moritzburg (DE); Bernd Hanke, Dresden (DE); Benjamin Gohl, Dresden (DE); Richard Dorninger, Coswig (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/600,147

(22) PCT Filed: Aug. 12, 2020

(86) PCT No.: PCT/EP2020/072618
§ 371 (c)(1),
(2) Date: Sep. 30, 2021

(87) PCT Pub. No.: WO2021/032567
PCT Pub. Date: Feb. 25, 2021

(65) Prior Publication Data

US 2022/0089391 A1 Mar. 24, 2022

(30) Foreign Application Priority Data

Aug. 21, 2019 (DE) ..... 10 2019 122 494.2
Aug. 21, 2019 (DE) ..... 10 2019 122 495.0

(51) Int. Cl.
*B65H 5/22* (2006.01)
*B65H 3/08* (2006.01)
(Continued)

(52) U.S. Cl.
CPC ..... *B65H 3/0816* (2013.01); *B65H 5/224* (2013.01); *B65H 5/34* (2013.01); *B65H 7/00* (2013.01);
(Continued)

(58) Field of Classification Search
CPC ..... B65H 11/002; B65H 11/00; B65H 11/005; B65H 5/34; B65H 5/224; B65H 3/0816;
(Continued)

(56) References Cited

U.S. PATENT DOCUMENTS 5,213,036 A * 5/1993 Tokuno ..... B65H 3/124 101/232
5,595,381 A * 1/1997 Schickedanz ..... B65H 3/0816 271/12
(Continued)

FOREIGN PATENT DOCUMENTS

CN 101007601 A 8/2007
CN 101269753 A 9/2008
(Continued)

OTHER PUBLICATIONS

International Search Report of PCT/EP2020/072618 dated Nov. 18, 2020.
(Continued)

*Primary Examiner* — Luis A Gonzalez
(74) *Attorney, Agent, or Firm* — Mattingly & Malur, PC

(57) ABSTRACT

A device is provided for feeding sheets to a sheet-processing machine having at least one processing mechanism. A feeder head is provided for cyclically separating the sheets from a pile of such sheets and has transporting suckers for transporting the sheets to a belt table. The belt table has at least one revolving transport belt which is guided over at least two feed rollers. A first drive is assigned to at least one feed roller and a sheet flap, which is connected to a pivotally mounted shaft, is provided between the transporting suckers and the at least one transport belt. A second drive is assigned to the shaft, for pivoting that shaft. A sheet arrival sensor, which is arranged between the belt table and the processing mechanism, generates first signals representing the arrival of the sheets for a sequence of sheets. A clock generator generates
(Continued)

second signals representing the angular position of the at least one processing mechanism, and has a controller, which controls the first drive as a function of the second signals and which controls the second drive as a function of the first and second signals.

9 Claims, 2 Drawing Sheets

(51) Int. Cl.
*B65H 11/00* (2006.01)
*B65H 5/34* (2006.01)
*B65H 7/00* (2006.01)

(52) U.S. Cl.
CPC ..... *B65H 11/002* (2013.01); *B65H 11/005* (2013.01); *B65H 2513/10* (2013.01); *B65H 2801/21* (2013.01)

(58) Field of Classification Search
CPC ..... B65H 2801/21; B65H 2513/10; B65H 2513/102
See application file for complete search history.

(56) References Cited

U.S. PATENT DOCUMENTS

| | | | | |
|---|---|---|---|---|
| 5,613,675 | A * | 3/1997 | Kruger | B65H 5/34 271/265.01 |
| 5,626,077 | A * | 5/1997 | Muller | B41F 33/10 101/484 |
| 7,946,571 | B2 * | 5/2011 | Weiss | B65H 7/20 271/10.01 |
| 2009/0108515 | A1 | 4/2009 | Weiss | |

FOREIGN PATENT DOCUMENTS

| | | | |
|---|---|---|---|
| CN | 103253536 | A | 8/2013 |
| CN | 109476152 | A | 3/2019 |
| DE | 4331610 | A1 | 3/1995 |
| DE | 10022585 | A1 | 11/2001 |
| DE | 10101125 | A1 | 7/2002 |
| DE | 10216135 | A1 | 10/2003 |
| DE | 102007051945 | A1 | 5/2009 |
| DE | 102009046089 | A1 | 5/2011 |
| DE | 102017202922 | A1 | 8/2018 |
| EP | 0644139 | A1 | 3/1995 |
| EP | 1352742 | A1 | 10/2003 |
| EP | 1281647 | B1 | 9/2006 |
| EP | 2135743 | A2 | 12/2009 |

OTHER PUBLICATIONS

Chinese Office Action received in corresponding Chinese Application No. 202080022982.8 dated Apr. 29, 2022.

* cited by examiner

DEVICE FOR FEEDING SHEETS

CROSS-REFERENCE TO RELATED APPLICATIONS

This application is the US national phase, under 35 USC section 371, of PC T/EP2020/072618, filed Aug. 12, 2020; published as WO 2021/032567 A1 on Feb. 25, 2021, and claiming priority to DE 10 2019 122 494.2, filed Aug. 21, 2019, and to DE 10 2019 122 495.0, filed Aug. 21, 2019, the disclosures of which are expressly incorporated herein in their entireties by reference.

FIELD OF THE INVENTION

The present invention relates to a device for feeding sheets, comprising a feeder head for cyclically separating the sheets from a pile and comprising transporting suckers for transporting the sheets to a belt table. Such devices are used, in particular, in conjunction with sheet-processing machines or as an integral part of sheet-processing machines. In connection with uses in sheet-processing machines configured as printing presses, they are also referred to as feeders.

BACKGROUND OF THE INVENTION

A method for controlling the sheet feed to a sheet-processing machine comprising a sheet feeder, which, among other things, comprises a feeder head for separating the sheets from a pile and a belt table or a suction belt table, is known from DE 102 16 135 A1. The sheets are transported to the machine and, in the process, are checked for double, missing or skew sheets. When such a sheet is present, or in the event of disruptions in the downstream machine, the sheet feed is halted, wherein a sensing device detecting the height of the pile is provided, and the sheet feeder is driven by dedicated drives, which are controlled by means of processing electronics linked to a control unit of the downstream machine.

EP 1 281 647 B1 introduces a method for conveying sheets in a sheet feeder of a sheet-processing machine. In the sheet-processing machine, the speed of operation of the transport belt for conveying the imbricated sheets can be varied according to specified speed profiles, regardless of the operating speed of the machine.

A feeder is known from DE 10 2007 051 945 A1, which comprises multiple components for influencing the sheets, which independently of one another are assigned activatable drives. The components include a feeder head, which is used to separate the sheets of a pile, a suction belt table, which is used to transport the sheets in imbricated form, as well as a flap shaft. Each of the components comprises a dedicated drive.

In the drive systems of the known suction belt tables, the slack run of the suction belts used is located on the sheet-transporting table surface, while the tight run is located on the underside of the belt table. The suction belts and the sheet series resting thereon are pushed, which has a disadvantageous effect on the conveying accuracy.

DE 10 2009 046 089 A1 discloses a sheet feeder of a sheet-processing machine, wherein the sheet feeder comprises a sheet source, a feeder head, a conveyor belt, and an alignment means connected downstream of the conveyor belt. The transport speed of the conveyor belt is controlled as a function of a measurement signal of a sheet arrival sensor.

EP 2 135 743 A2 discloses a feeder head, comprising a sheet feeder for separating sheets from a pile and timing rollers for transporting the separated sheets to a belt table. Dedicated drives are provided for driving the feeder head.

A device for connecting or disconnecting a sheet feeder to or from a sheet printing press at a correct angle of rotation during a working cycle of the sheet feeder is known from DE 100 22 585 A1.

EP 0 644 139 A1 describes a sheet feeder unit comprising a suction head unit by way of which sheets can be removed individually from a pile and fed to a belt table, and can be fed from the belt table to a sheet-processing machine. The working cycle of the suction head unit is controlled in a leading or trailing manner as a function of the signals of a sheet arrival sensor.

DE 101 01 125 A1 shows a sheet feeder comprising a feeder head for cyclically separating the sheets from a pile and transporting them to a belt table. A drive is assigned to the belt table, which drives the transport belt at a periodically changing speed.

A suction belt table of a sheet feeder is known from DE 10 2017 202 922 A1, which comprises multiple suction belts arranged behind one another. Each of the suction belts is assigned a dedicated drive, which is driven according to a non-uniform speed profile.

SUMMARY OF THE INVENTION

It is the object of the present invention to create a device for feeding sheets in which the sheets are transported with greater accuracy and, in particular, with greater uniformity.

The object is achieved according to the invention by the provision of a device for feeding sheets to a sheet-processing machine having at least one processing mechanism including a feeder head for cyclically separating the sheets from a pile of sheets and having transporting suckers for transporting the sheets to a belt table. The belt table includes at least one revolving transport belt, which is guided over at least two feed rollers, with the first drive being assigned to at least one feed roller. A sheet flap, which is connected to a pivotably mounted shaft, is provided between the transporting suckers in the at least one transport belt. A second drive is assigned to the shaft, for pivoting that shaft. A sheet arrival sensor, which is arranged between the belt table and the processing mechanism, generates first signals representing the arrival of the sheets for a sequence of sheets. A clock generator, which generates second signals comprising the angular position of the at least one processing mechanism, includes a controller, which controls the first drive as a function of the second signals, and which controls the second drive as a function of the first end second signals.

The advantages to be achieved with the present invention are, in particular, that fluctuations in the distances between the sheets of the sheet series are decreased, and the sheet arrival for each individual sheet at the end of the transport path of the suction belt table can be achieved at precisely the specified time. In particular, a change in the elasticity or the length of the suction belt, which can occur with aging of the suction belt, no longer affects the transport of the sheets, or only to a reduced extent.

BRIEF DESCRIPTION OF THE DRAWINGS

Exemplary embodiments of the invention are illustrated in the set of drawings and will be described in greater detail below.

The drawings show.

DESCRIPTION OF THE PREFERRED EMBODIMENT

Figure 1:
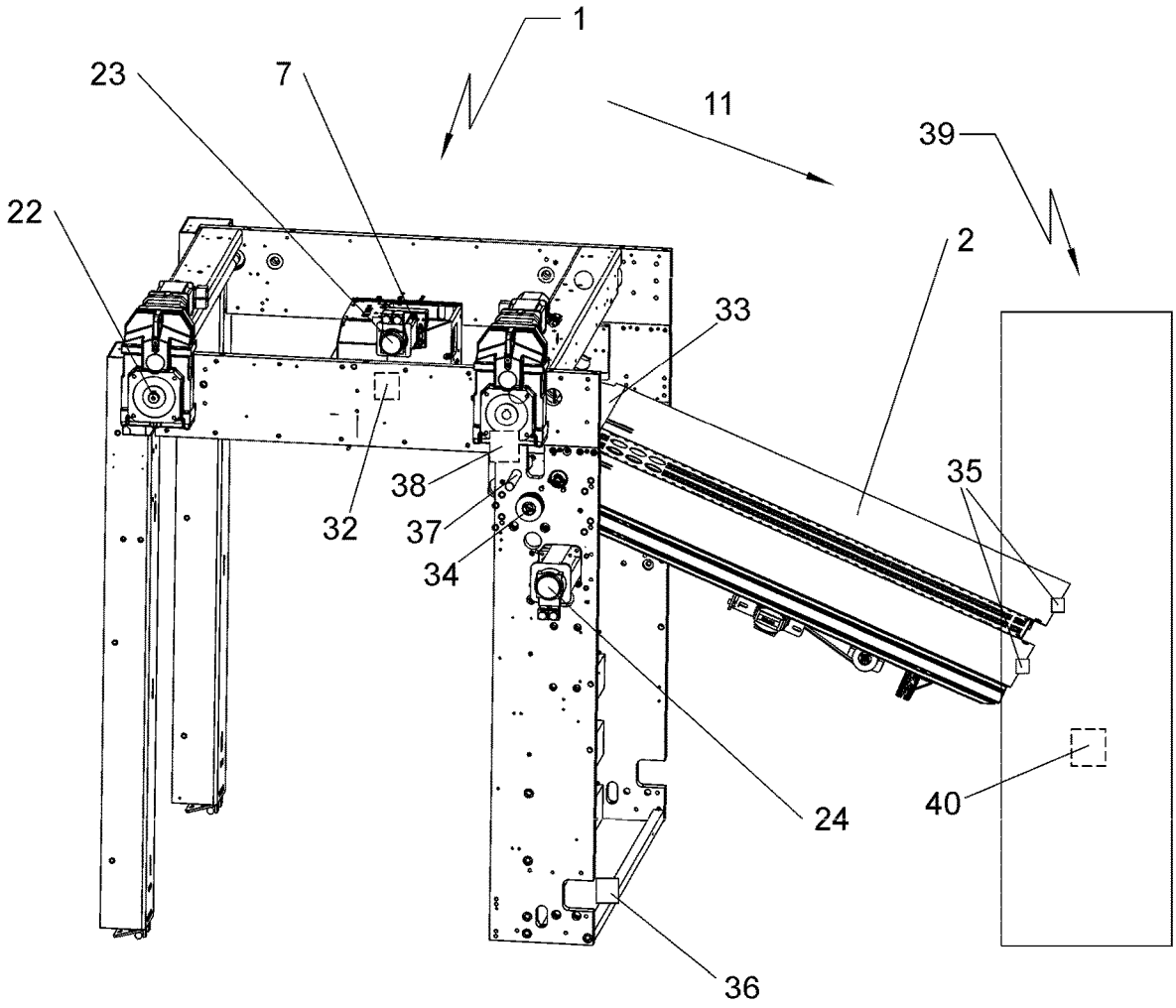
FIG. 1 a device for feeding sheets, comprising a suction belt table.
Figure 2:
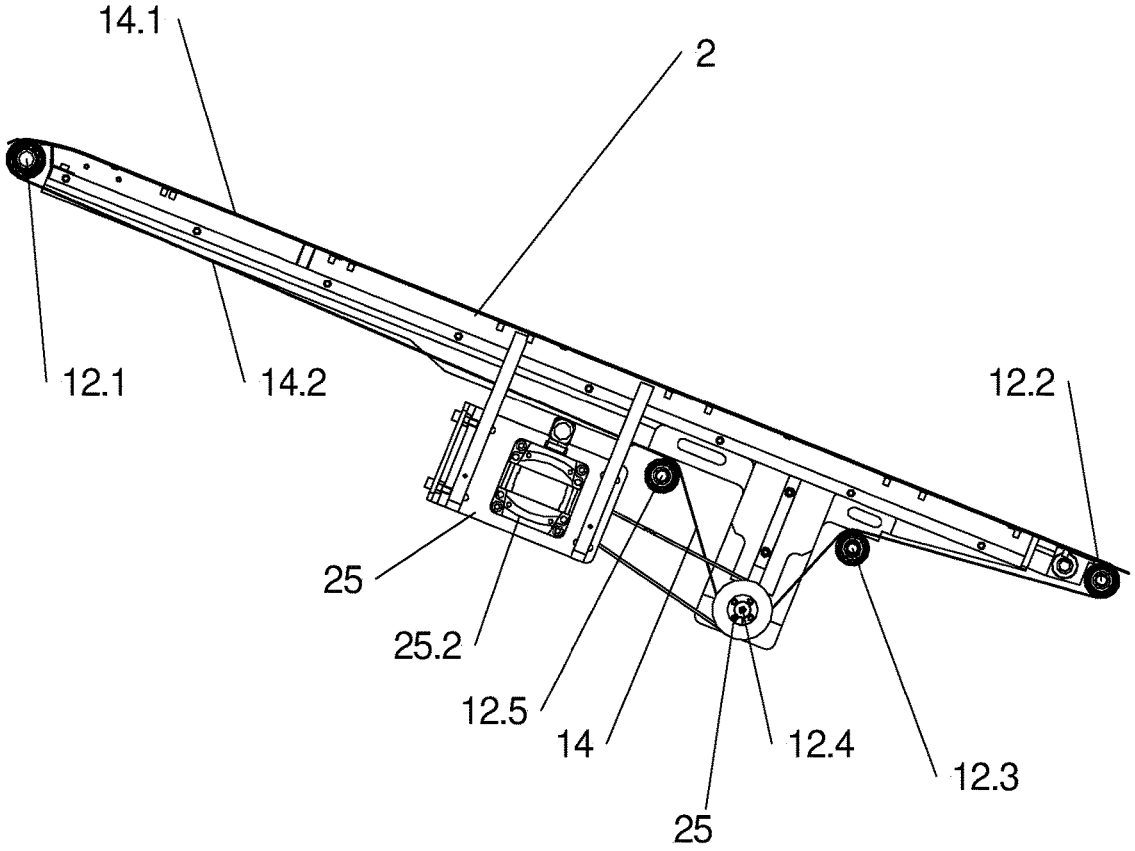
FIG. 2 a detailed side view of the suction belt table.
Figure 3:
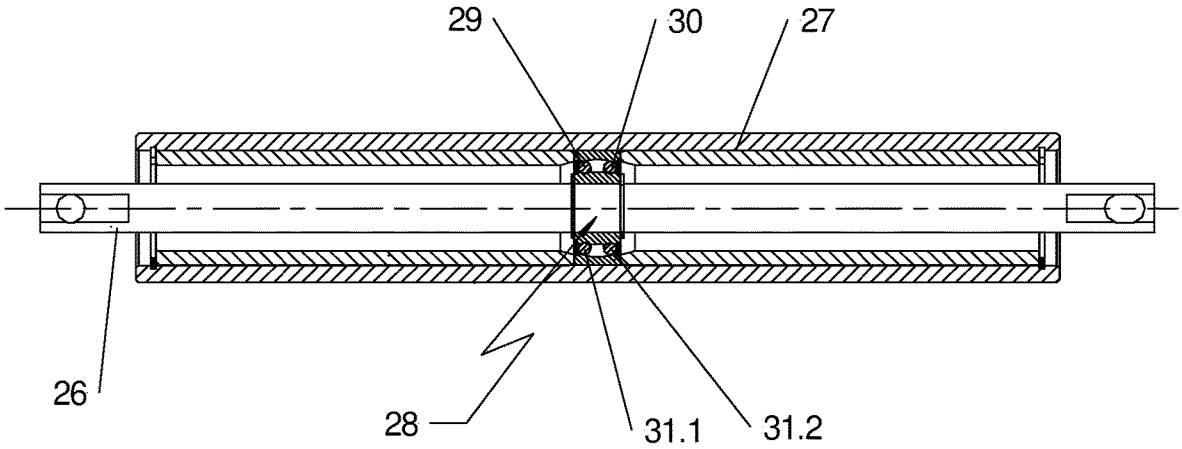
FIG. 3 a schematic illustration of a feed roller configured as a dancer roller.

The device for feeding sheets can be configured as a feeder 1 of a sheet-processing machine, in particular a sheet printing press or a die-cutting machine, and shall be described hereafter based on this example.

The device for feeding sheets, in particular the feeder 1, preferably comprises a main pile carrier, in particular a pile board, on which a pile composed of the sheets can be positioned. The pile board is attached to transport means.

At the rear and at the sides of the pile, blowers can be provided for pre-loosening the sheets on the pile as well as for blowing air beneath the sheets during transport. To be able to form an air cushion carrying the sheets, metal side plates or guide elements that laterally delimit the pile can additionally be arranged next to the pile.

A feeder head 7 is arranged in the region of the upper side of the pile.

The feeder head 7 preferably comprises a separating sucker and a transporting sucker. The feeder head 7 is preferably arranged in the feeder 1 so as to be height-adjustable. In addition, the feeder head 7 can be displaceably mounted in or counter to a transport direction 11 to adapt to formats. The feeder head 7, in particular the separating suckers thereof, are used to cyclically separate the sheets from the pile, wherein the transporting sucker picks up the separated sheets and conveys them in the transport direction 11. A sensing device detecting the height of the pile can be arranged in the pile region.

The transporting sucker transports the sheets to a belt table 2. The belt table 2 has a transport plane in which the sheets are transported by at least one revolving transport belt 14. A respective section of the at least one transport belt 14 is preferably guided over at least two upper feed rollers 12.1, 12.2 in the transport plane. At least one further feed roller 12.3, 12.4, 12.5 is provided next to the upper feed rollers 12.1, 12.2, which guides the at least one transport belt 14 outside, in particular beneath, the transport plane. A first drive 25 is assigned to the at least one further feed roller 12.3, 12.4, 12.5, so that the section of the at least one transport belt 14 which is guided in the transport plane forms the tight run 14.1 of the transport belt 14. The section of the at least one transport belt 14 guided outside the transport plane forms the slack run 14.2 of the at least one transport belt 14.

The first drive 25 is preferably configured as a motor 25.2. The first drive 25 can be directly assigned to the shaft of a further feed roller 12.3, 12.4, 12.5 or be connected via a gear wheel pair or a belt drive, in particular a toothed belt drive, to the further feed roller 12.3, 12.4, 12.5 in terms of transmission.

It is also possible for two or three further feed rollers 12.3, 12.4, 12.5 to be arranged outside, in particular beneath, the transport plane, over which the at least one transport belt 14 is guided, wherein, in the case of three further feed rollers 12.3, 12.4, 12.5, the first drive 25 can be assigned to the center one of the three further feed rollers 12.3, 12.4, 12.5. If multiple further feed rollers 12.3, 12.4, 12.5 are provided, over which the at least one transport belt 14 is guided, the first drive 25 can alternatively be assigned to the further feed roller 12.3, 12.4, 12.5 that is arranged the furthest from the feeder head 7. On the sheet-transporting side of the belt table 2, the transport belt 14 is consequently configured as a pulling belt. This has the advantage that the sheets located on the belt table 2 in the form of a sheet series can be transported more smoothly and uniformly, resulting in fewer disruptions.

The diameters of the feed rollers 12.1, 12.2, 12.3, 12.4, 12.5 can be different in size. The diameter of the feed roller 12.3, 12.4, 12.5 to which the first drive 25 is assigned is preferably larger than the diameter of the upper feed rollers 12.1, 12.2.

A tensioning device is preferably assigned to one of the further feed rollers 12.3, 12.4, 12.5, by way of which the respective further feed roller 12.3, 12.4, 12.5 can be displaced with respect to the at least one transport belt 14 so as to vary the tension thereof, and can be fixed in the displaced position. The tensioning device can also comprise an energy accumulator, in particular a spring system, the spring force of which is settable and which tightens one of the further feed rollers 12.3, 12.4, 12.5 in a spring-loaded manner against the transport belt 14.

At least one of the feed rollers 12.1, 12.2, 12.3, 12.4, 12.5, in particular one of the further feed rollers 12.3, 12.4, 12.5, is preferably configured as a dancer roller. A feed roller 12.1, 12.2, 12.3, 12.4, 12.5 configured in this way has a correcting belt guidance function, in particular when force and/or load changes occur in or on the transport belt 14. The feed roller 12.1, 12.2, 12.3, 12.4, 12.5 configured as a dancer roller has two degrees of freedom and corrects belt run errors automatically. Designing a feed roller 12.1, 12.2, 12.3, 12.4, 12.5 in the form of a dancer roller thus enables both a tilting movement thereof, transversely to the transport direction 11, and a rotational movement in the transport direction 11.

The dancer roller comprises a fixed shaft 26 and a hollow-cylindrical roller body 27 arranged rotatably about the shaft 26, coaxially to the shaft 26. A self-aligning bearing 28 acts between the shaft 26 and the roller body 27. The self-aligning bearing 28 can be configured as a ball joint bearing or as a spherical roller bearing or in another suitable form. The self-aligning bearing 28 is preferably arranged in the center between the two ends of the roller body 27, so that the center of mass of the roller body 27 is located above the self-aligning bearing 28, and the roller body 27 is balanced in relation to the self-aligning bearing 28.

The self-aligning bearing 28 can comprise an outer ring 29 connected to the roller body 27 and an inner ring 30 connected to the shaft 26. The outer ring 29 is supported with respect to the inner ring 30 by two ball rows 31.1, 31.2 or roller rows 31.1, 31.2 spaced apart from one another. A shared hollow-spherical raceway is preferably formed at the outer ring 29 and/or at the inner ring 30 for both ball rows 31.1, 31.2 or roller rows 31.1, 31.2. The feed roller 12.1, 12.2, 12.3, 12.4, 12.5, in particular the further feed roller 12.3, 12.4, 12.5, to which the first drive 25 is assigned, preferably has a convex shape, while all other feed rollers 12.1, 12.2, 12.3, 12.4, 12.5 can be configured to have a cylindrical shape. The feed roller 12.1, 12.2, 12.3, 12.4, 12.5 configured to have the convex shape and acting as a drive roller also preferably assumes a centering function in the system, in addition to the driving function. The feed roller 12.1, 12.2, 12.3, 12.4, 12.5 to which the first drive 25 is assigned is accordingly preferably different from the feed roller 12.1, 12.2, 12.3, 12.4, 12.5 configured as a dancer roller.

In a preferred embodiment of the device comprising two or three further feed rollers 12.3, 12.4, 12.5, which are arranged beneath the transport plane of the belt table 2, the first drive 25 can either be assigned to one of the two or to the center one of the three further feed rollers 12.3, 12.4, 12.5, wherein another further feed roller 12.3, 12.4, 12.5 is configured as the dancer roller.

Instead of a single transport belt 14, it is also possible for two or more transport belts 14 to be provided, which are arranged at a distance from one another and guided over upper feed rollers 12.1, 12.2 and further feed rollers 12.3, 12.4, 12.5.

The transport belts 14 are preferably configured as suction belts and have openings. The suction belts are preferably supplied with suction air by suction boxes, which can be integrated into the belt table 2. Sheets to be transported are held on a transport belt 14 configured as a suction belt due to the action of the suction air.

A processing mechanism of a sheet-processing machine 39, as seen in FIG. 1, can be arranged downstream of the belt table 2.

The processing mechanism 39 is preferably an offset printing mechanism, a finish coating mechanism, an inkjet printing mechanism, or a die-cutting mechanism.

As may be seen in FIG. 1, a sheet flap 33, which is connected to a pivotably mounted shaft 34, is formed between the transporting suckers 32 and the at least one transport belt 14 of the belt table 2. The functional unit comprising the shaft 34 and the sheet flap 33 is also referred to as a flap shaft in technical jargon. The flap shaft extends across the width of the pile. The sheet flap 33 is pivoted for each sheet to be conveyed from a vertical position, in which the sheet flap 33 forms a stop, into a horizontal position, in which the sheet flap 33 forms a guide surface.

So-called timing rollers 38 preferably cooperate with the at least one transport belt 14 of the belt table 2. The timing rollers 38 can be assigned to a pivotably mounted timing roller shaft 37, which is pivoted synchronized with the sheet sequence, so that the timing rollers 38 guide the front region of each sheet against the at least one transport belt 14 of the belt table 2.

Multiple individual drives, which can be activated independently of one another, are preferably provided for driving the components inducing the sheet transport. In addition to the first drive 25 assigned to a feed roller 12.1, 12.2, 12.3, 12.4, 12.5, a second drive 24 can be provided, which is assigned to the shaft supporting the sheet flap. The second drive 24 can also be configured to jointly drive the timing roller shaft and the shaft connected to the sheet flap.

The timing roller shaft 37 and/or the shaft connected to the sheet flap 33 are preferably connected to the second drive 24 by way of a gear mechanism.

In addition, a third drive 22 can be assigned to the main pile carrier for the vertical displacement thereof. If a non-stop mechanism is provided, the main pile carrier cooperates with an auxiliary pile carrier during pile changing, which can be configured as a rake or roller rack and to which a fourth drive is preferably assigned for the vertical displacement thereof.

A fifth drive 23 can be provided for driving the feeder head 7 and/or the transporting sucker, all as seen in FIG. 1.

A sheet arrival sensor 35, which is preferably arranged at the end of the belt table 2, as seen in FIG. 1, can be configured to detect the arrival of the sheets. The sheet arrival sensor 35 can be used to detect the position of the sheets at a particular time prior to the sheets entering the processing mechanism 39. The sheet arrival sensor 35 generates first signals representing the arrival of the sheets for a sequence of sheets.

A clock generator 40, which generates second signals representing the angular position of the at least one processing mechanism 39, is configured to detect the angular position of the at least one processing mechanism 39.

It is only possible to feed sheets to the at least one processing mechanism 39 when the at least one processing mechanism 39, in particular the sheet-guiding cylinder thereof, is in a particular angular position. To achieve this, the individual drives 22, 23, 24, 25 have to be activated accordingly.

The drives 22, 23, 24, 25 as well as the clock generator and the sheet arrival sensor are connected to a controller 36, which is depicted in FIG. 1.

The controller 36 preferably controls the first drive 25 of a further feed roller 12.3, 12.4, 12.5 as a function of the signals of the clock generator 40, in particular the second signals. In other words, the movement of the transport belt or belts 14 of the belt table 2 exclusively follows the movement of the at least one processing mechanism 39.

In contrast to the first drive 25, the second drive 24 is not only controlled by the controller 36 according to the second signals of the clock generator 40, but additionally also according to the first signals of the sheet arrival sensor 35.

Respective clock-based speed profiles can be entered into the controller 36 for controlling the first and second drives 25, 24. The speed profiles can have a discontinuous speed curve.

The controller 36 preferably ascertains the phase positions of the first signals in relation to the phase positions of the second signals and controls the second drive 24 as a function of the ascertained phase positions of the first signals in relation to the phase positions of the second signals. In this way, the occurrence of sheets arriving too early (early sheets) or the occurrence of sheets arriving too late (late sheets) can be inferred, and appropriate counter measures can be taken.

The controller 36 is, in particular, configured to control the second drive 24 so as to shift, as a function of the phase positions of the first signals in relation to the phase positions of the second signals, the phase positions of the speed profile of the second drive 24 in a leading or trailing manner with respect to the phase positions of the speed profile of the first drive 25, or to activate the second drive 24 using a speed profile that has an increased or a decreased average speed.

If, for example, a late sheet is established as a result of the ascertainment of the phase positions, it is possible through an increased speed of the fifth drive 23 of the feeder head 7 and/or of the transporting sucker 32, and through an increased speed of the second drive 24 at the sheet flap with 33, respect to the transport belt 14, to induce the leading sheet edge of succeeding sheets to arrive earlier at the processing mechanism 39. The imbrication length between the sheets is thereby reduced.

The controller 36 can respond to an early sheet in a corresponding manner, with the difference that the speed of the fifth drive 23 and of the second drive 24 is reduced, and the imbrication length, that is, the distance between the leading edges of the sheets, is increased.

It is also possible to provide multiple sheet arrival sensors 35 monitoring the sheets. The invention is not limited to the above-described exemplary embodiment. It is also possible for other components of the feeder 1 that are not mentioned in the exemplary embodiment and equipped with drives to be provided.

While a preferred embodiment of a device for feeding sheets, in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A sheet-processing machine comprising;

at least one processing mechanism;

a feeder head for cyclically separating the sheets from a pile, the feeder head comprising transporting suckers for transporting the sheets;

a belt table comprising at least one revolving transport belt, which is guided over at least two feed rollers wherein the transporting suckers are configured to transport the sheets to the belt table;

a first drive assigned to at least one feed roller of the at least two feed rollers;

a sheet flap, which sheet flap is connected to a pivotably mounted shaft, the sheet flap being provided between the transporting suckers and the at least one transport belt;

a second drive assigned to the pivotably mounted shaft for pivoting the pivotable mounted shaft, a sheet arrival sensor, which sheet arrival sensor is arranged between the belt table and the at least one processing mechanism and which sheet arrival sensor generates first signals representing the arrival of the sheets for a sequence of sheets;

a clock generator, which clock generator generates second signals representing an angular position of the at least one processing mechanism; and a controller, which controller controls the first drive as a function of the second signals, and which controls the second drive as a function of the first and second signals, wherein clock-based speed profiles, describing a duration of time for handling one sheet are stored in the controller for controlling the first and second drives.

2. The sheet-processing machine according to claim 1, wherein the clock-based speed profiles have a discontinuous speed curve.

3. The sheet-processing machine according to claim 2, wherein the controller is designed to ascertain the phase positions of the first signals in relation to the phase positions of the second signals.

4. The sheet-processing machine according to claim 3, wherein the controller is designed to control the second drive as a function of the phase positions of the first signals in relation to the phase positions of the second signals.

5. The sheet-processing machine according to claim 1, one of wherein the controller is designed to control the second drive in such a way that, as a function of phase positions of the first signals in relation to phase positions of the second signals, phase positions of the speed profile of the second drive are shifted in one of a leading and a trailing manner with respect to the phase positions of the speed profile of the first drive, and wherein the second drive is driven using a speed profile that has one of an increased and a decreased average speed.

6. The sheet-processing machine according to claim 1, wherein a pivotably mounted timing roller shaft carrying timing rollers is provided, and wherein the second drive is designed to drive the timing roller shaft and the shaft connected to the sheet flap.

7. The sheet-processing machine according to claim 1, wherein a fifth drive is assigned to one of the feeder head and the transporting suckers, and wherein the controller controls the fifth drive as a function of the first and second signals.

8. The sheet-processing machine according to claim 7, wherein the controller controls the first drive as a function of the second signals.

9. The sheet-processing machine according to claim 1, wherein the at least one processing mechanism is an offset printing mechanism.

* * * * *